United States Patent [19]

Morris et al.

[11] Patent Number: 4,645,135

[45] Date of Patent: Feb. 24, 1987

[54] METHOD FOR WINDING ELASTOMERIC RIBBON

[75] Inventors: Marion C. Morris; Randolph J. Hill, both of Appleton; Richard H. Frick, Neenah; Hugo L. Kons, Appleton, all of Wis.

[73] Assignee: Kimberly-Clark Corporation, Neenah, Wis.

[21] Appl. No.: 790,701

[22] Filed: Oct. 24, 1985

Related U.S. Application Data

[63] Continuation-in-part of Ser. No. 681,004, Dec. 13, 1984, abandoned, which is a continuation of Ser. No. 298,369, Sep. 1, 1981, abandoned.

[51] Int. Cl.[4] ..... B65H 18/08

[52] U.S. Cl. ..... 242/67.1 R; 242/158 R; 242/158.4 R; 242/DIG. 2

[58] Field of Search ..... 242/67.1 R, 55, DIG. 2, 242/1, 18 R, 18 DD, 43 R, 67.3 R, 158 R, 158.2, 158.4 R, 158.4 A

[56] References Cited

U.S. PATENT DOCUMENTS

| | | | |
|---|---|---|---|
| 1,267,080 | 5/1918 | Judelshon | 242/67.1 R |
| 2,135,668 | 11/1938 | Judelshon | 242/67.1 R |
| 2,437,725 | 3/1948 | Conner | 242/158.4 A |
| 2,562,733 | 7/1951 | Nelson et al. | 242/158.4 R |
| 2,912,187 | 11/1959 | Rau, Jr. | 242/158.4 R |
| 3,042,326 | 7/1962 | Lamb et al. | 242/158.4 R |
| 3,312,421 | 4/1967 | Kerr et al. | 242/158.4 R |
| 3,598,337 | 8/1971 | Mackie | 242/67.1 R |
| 3,877,655 | 4/1975 | Cardinal et al. | 242/67.1 R |
| 3,963,186 | 6/1976 | Vanden Aa | 242/158.4 R |
| 3,997,122 | 12/1976 | Helfand et al. | 242/67.1 R |
| 4,093,146 | 6/1978 | Haley | 242/158.2 |
| 4,170,504 | 10/1979 | Riggs | 242/DIG. 2 |
| 4,215,831 | 8/1980 | Williams et al. | 242/67.1 R |
| 4,300,967 | 11/1981 | Sigl | 156/164 |

OTHER PUBLICATIONS

Brochure—Amacoil Machinery, Inc., Apr. 1977.
Nonwovens Industries, Nov. 1984, p. 53.

*Primary Examiner*—Stanley N. Gilreath
*Attorney, Agent, or Firm*—Paul Yee

[57] ABSTRACT

A method for winding soft elastomeric ribbon on spools of substantially greater width than the width of the ribbon is provided which includes the winding of the ribbon on a surface driven spool. The ribbon passes through guides from a feed source, with the guides in proximity to the take-up spool. Traversing of the ribbon is provided by either shifting the guides or the take-up apparatus across the horizontal length less than the length of the spool to prevent overrunning of the outer edges of the spool. The invention also includes the spool wound with soft elastomeric ribbon to a thickness several times that of the ribbon and along a length several times greater than the width of the ribbon.

15 Claims, 3 Drawing Figures

METHOD FOR WINDING ELASTOMERIC RIBBON

CROSS-REFERENCES TO RELATED APPLICATIONS

The present invention is a continuation-in-part of application Ser. No. 681,004, filed Dec. 13, 1984, now abandoned, itself a continuation of application Ser. No. 298,369, filed Sept. 1, 1981, now abandoned, the disclosures of both related cases being incorporated by reference herein.

BACKGROUND OF THE INVENTION

Field Of The Invention

The invention relates to a method for winding elastomeric ribbon about a conventional spool and the wound spool resulting therefrom.

Elastomeric ribbon is coming into increasing use in the clothing industry due to its thinness, resilience and relative ease of manufacture. Polyurethane based ribbon is an example of such a soft elastomer and is generally made as a blown film or as sheet material by extruding the elastomer as a sheet and slitting it to the desired width. This ribbon is sold either in single width rolls or loosely piled in large boxes. It would be extremely advantageous if elastomeric polyurethane ribbon could be wound about large spools and unwound for use in commercial processes.

There are disadvantages associated with using polyurethane ribbon in this manner, however. By the nature of the material, polyurethane ribbon easily tangles and twists. This prevents successful winding of large amounts of the ribbon and accounts for the polyurethane ribbon being provided in slit rolls of only a single ribbon width or in bulky boxes of loosely piled ribbon. As might be expected, there are several problems inherent in utilizing these boxes or rolls in commercial processes. The most obvious is that the supply in either a box or roll is soon depleted during high speed manufacture of a product utilizing this elastomeric material, such as processes for manufacturing disposable diapers which utilize the elastomer as a binding for leg openings. Since no practical way has been found to obtain a flying splice of polyurethane ribbon ends to each other, the process must be stopped and a new roll brought into play each time a box or roll is exhausted. This is cumbersome and results in a substantial amount of "down time" for an otherwise highly automated, high speed process. If during feeding of the ribbon, a box of material is used, twists and tangles which snarl the machinery are common and also result in substantial amounts of down time even though the amount of polyurethane material contained in these boxes may be greater than the amount which can be wound in single width rolls.

SUMMARY OF THE INVENTION

In accordance with the present invention there is provided a method for winding onto a spool a soft elastomeric ribbon having wide surfaces of a width greater than its thickness, the spool having an axial length greater than the width of the ribbon, and the method comprising the steps of: feeding the ribbon from a ribbon source towards the spool; at a ribbon traversing station, maintaining the wide surfaces of the ribbon disposed transversely to the longitudinal axis of the spool and applying to only the wide surfaces of the ribbon a traversing force sufficient to traverse the ribbon along a traverse path parallel to the longitudinal axis of the spool; and, between the traversing station and the spool, turning the ribbon to dispose the wide surfaces thereof parallel to the longitudinal axis of the spool at the point where the ribbon is wound onto the spool.

Other aspects of the invention include one or more of the following features: the traversing force applied to the ribbon is periodically reversed whereby to wind multiple layers of the ribbon onto the spool; supporting the ribbon adjacent to the point of transfer of the ribbon to the spool; supporting the ribbon by contacting a wide surface thereof on a support means under sufficient tension such that frictional engagement of the ribbon on the support means militates against node-forming tendencies of the ribbon on the spool; maintaining the ribbon under tension while feeding it from the ribbon source to the spool; and utilizing a ribbon having a ratio of width to thickness of at least about 3:1.

In another aspect of the invention there is provided a method such as any one of those described above which includes accelerating the ribbon traversing speed at the respective ends of the traverse path for a portion, less than one-half, of the traverse path whereby the average traversing speed at the ends is greater than the average traversing speed along the remainder of the traverse path.

A related aspect of the present invention includes maintaining a winding angle of less than 90° between the longitudinal axis of the spool and that of the ribbon being wound thereon, reversing the winding angle at the respective ends of the traverse path and accelerating the ribbon traversing speed during reversal of the winding angle whereby the average ribbon traversing speed during reversal of the winding angle is greater than the average ribbon traversing speed along the remainder of its traversing path.

Yet another aspect of the invention includes gradually reducing the length of the traverse path by incrementally moving the respective ends thereof inwardly towards each other whereby to provide a tapered wound spool of ribbon.

According to another aspect of this invention, soft elastomeric ribbon dispensed from a feeding mechanism can be wound on a large spool allowing substantial bulk storage and subsequent high speed continuous dispensing of the ribbon by utilizing in combination, an uptake spool, which may be surface driven by a driving roll, a guide located between the feeding mechanism and the uptake spool but close to the uptake spool, traversing means provided by reciprocating movement of either the spool and the driving roll or the traversing guide, and sufficient tension during the conveying of the ribbon in the winding process to allow uptake without substantial sagging of the ribbon but insufficient tension to substantially stretch the ribbon.

Soft elastomeric ribbon, as used in this invention, refers to the class of materials having a high degree of elasticity but also substantial amounts of surface deformability. An example of such a material is Tuftane 410® polyurethane. Tuftane 410 is a registered trademark of B.F. Goodrich Company, Akron, Ohio and according to ASTM test D 882-61T (MD) has a tensile strength of 6,000 psi, modulus at 100% elongation of 1,700 psi (for 1 mil film) and an elongation at break of 350%. Other elastomers having similar properties such as certain silicone elastomers and even soft rubber may be used according to the teachings of this invention. The term "ribbon" as used in this invention refers to a flat surfaced strip of elastomer having a width not greater than approximately two inches and a width to thickness ratio of at least 3 to 1. (The Tuftane® polyurethane discussed above has a thickness of 1.5 mils and a width to thickness ratio of 333.3 to 1.) Clearly, difficulties encountered in winding are exacerbated by ribbon which is comparatively thin and narrow. As the ribbon approaches sheet material size it becomes less difficult to handle with regard to the various processing steps of the subject invention, as the problems of folding and twisting during winding and uneven layering on the spool are not particularly acute. Therefore, the subject matter of this invention is particularly advantageous for the thinner, narrower gauge ribbons, say those having a width to thickness ratio of 10 to 1, and preferably 100 to 1 or more, and a width of about one inch or less.

BRIEF DESCRIPTION OF THE DRAWINGS

The process of the invention will more readily be understood by reference to the drawings, in which.

DETAILED DESCRIPTION OF THE PREFERRED EMBODIMENTS

Figure 1:
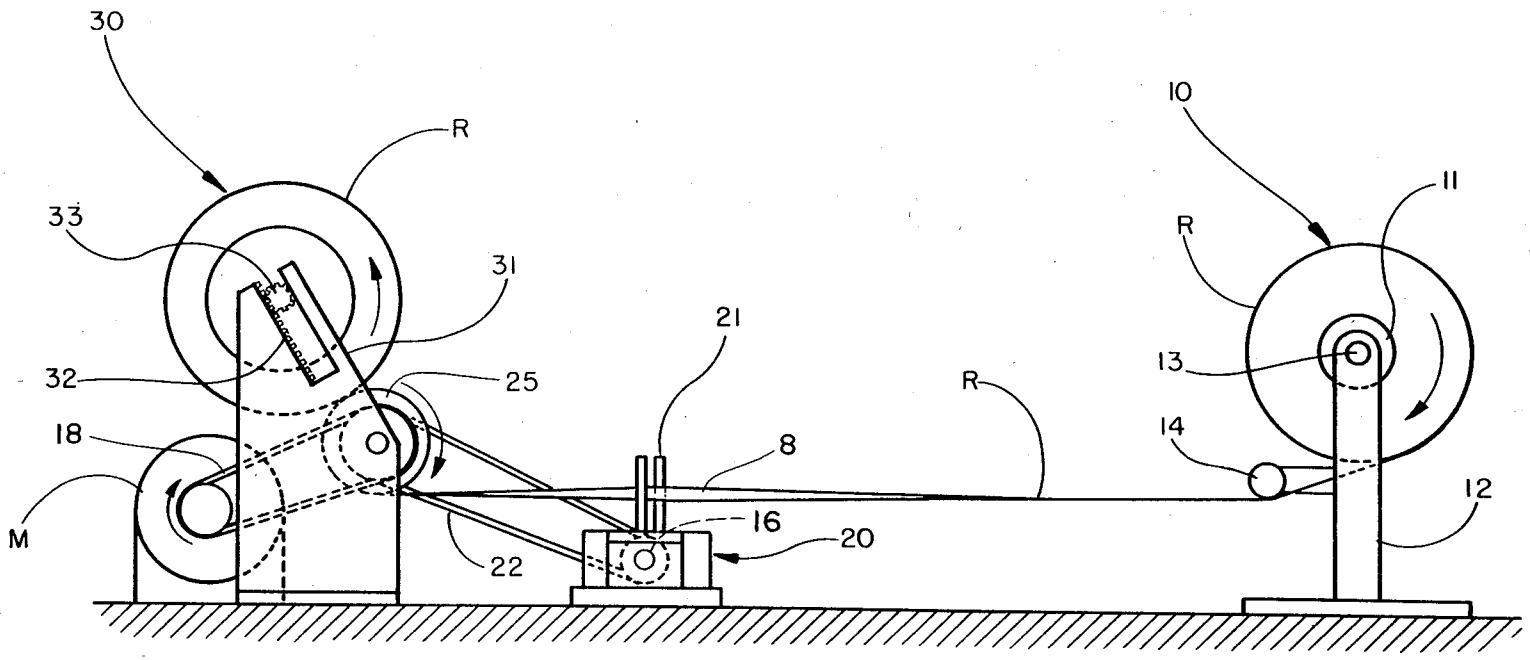
FIG. 1 is a side view in elevation of a winding apparatus useful in the process of this invention with parts omitted for clarity of illustration.
Figure 2:
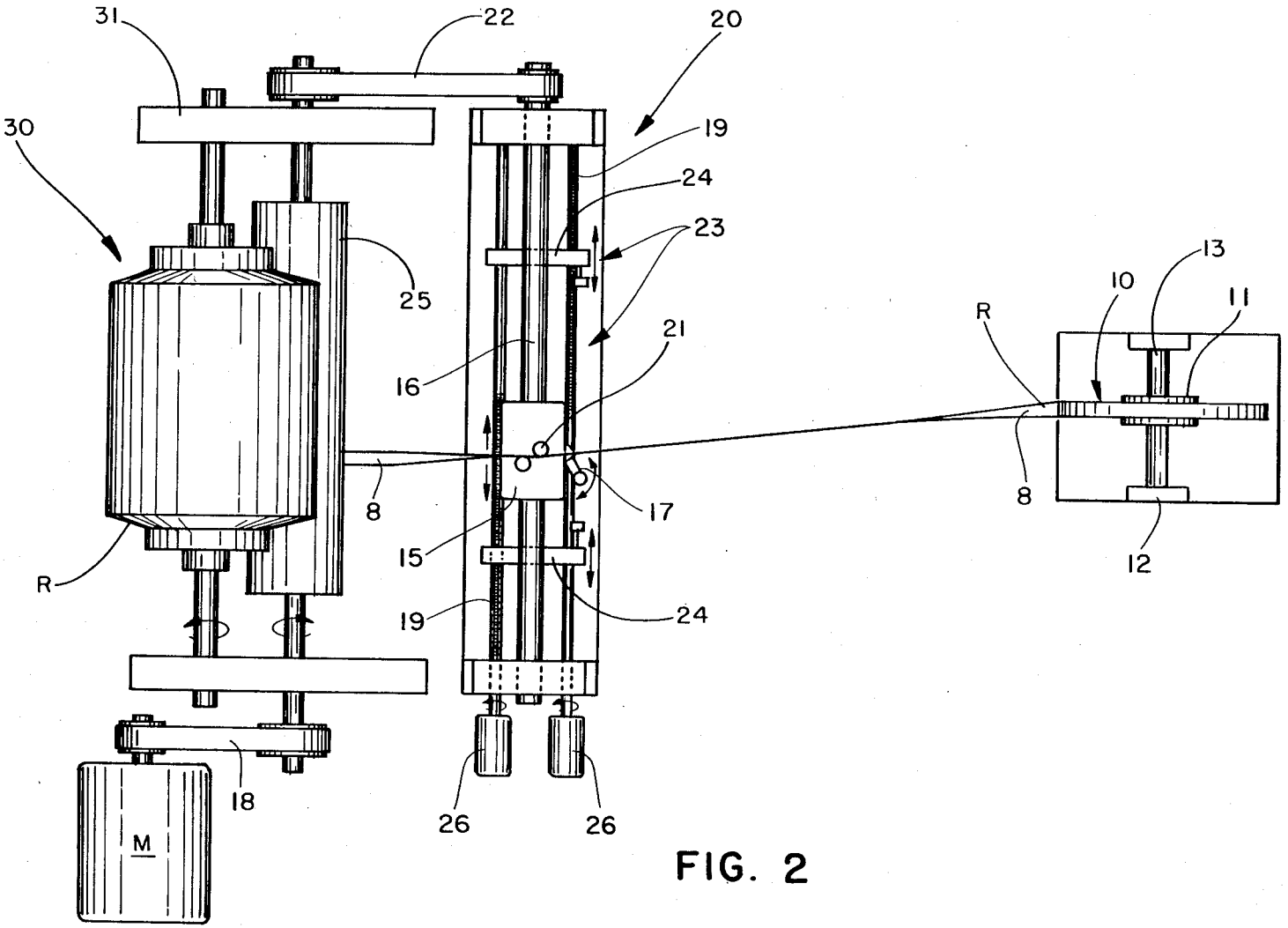
FIG. 2 is a plan view of the apparatus of FIG. 1.

With reference to FIGS. 1 and 2 of the drawings, a currently preferred embodiment of the invention is described in which a feed roll of a polyurethane elastomeric ribbon ½" wide and containing 4,000 lineal feet of the ribbon is placed upon an axle and spindle combination generally designated as 10 in FIG. 1. The roll is unwound about the axle 13 which is mounted upon stand 12 with the roll being wound about core 11 as obtained from the factory. The ribbon R passes under positioning roll 14 which serves both to position the ribbon R and to elongate and thereby tension the ribbon. From roll 14, as shown in FIG. 1, the ribbon R follows a substantially straight line pathway, which may be horizontal, to traversing means 20 thence to surface drive roll 25. From the drive roll 25, the ribbon R is transferred onto a level wound take-up spool generally designated as 30. The surface drive roll 25 is powered by a motor M via drive belt 18 with the speed of the drive roll 25 correlated to the traversing means 20 by drive belt 22. It should be noted that although, in the preferred embodiment of the invention, the roll 25 provides a surface drive for the spool 30, the spool 30 may be driven by other means for transferring the ribbon R onto the spool 30, which other means need not necessarily engage the wound ribbon R on the spool 30.

The guide means 21 may comprise rollers or simply guide rods and are mounted upon a carriage 15 (FIG. 2) which is mounted for movement in either direction along shaft 16 in response to rotation of shaft 16 by drive belt 22. The direction of travel of carriage 15 along shaft 16 is periodically reversed by a reversing switch 17 (FIG. 2), as described below. The axial length of the rollers comprising guide means 21 are disposed vertically in the preferred embodiment illustrated in FIG. 1. However, variations from the preferred embodiment are possible, for example, if the roll 25 and spool 30 have their axial lengths disposed vertically, the axial lengths of the guide means 21 may be positioned horizontally.

In FIG. 2, an indexing means includes a pair of driven threaded rods 19 and a pair of stop members 24 mounted thereon. Each of the rods 19 passes through corresponding ends of both the stop members 24 so that the latter are supported in a non-rotating position. Each rod 19 is threaded on one end, engages mating threads in one of stop members 24 and is rotatably driven by an associated small drive motor 26. (Motors 26 and rods 19 are omitted from FIG. 1 for clarity of illustration.) During winding of the ribbon R on spool 30, the direction of rotation of the rods 19 is such that the members 24 are driven inwardly towards each other. The reversing lever 17 of carriage 15 alternately engages the two stop members 24 and causes the reversal of the traverse direction by controlling a known type of drive mechanism (not shown) of carriage 15 which causes it to traverse rotating shaft 16 in the selected direction. Due to the inward movement of the members 24, the traverse reversal will also move inwardly to thereby produce a tapered edge on the wound ribbon on spool 30 as shown in FIG. 2.

Referring once more to FIG. 1, the take-up spool 30 is mounted about an axle 33 in forked member 31 having gear teeth 32. The axle 33 is adjusted by positioning along the various gear teeth as the thickness of the wound ribbon on the roll 30 increases or decreases. Other embodiments such as the utilization of a cantilever shaft on a pivot may be used to shift roll position with take-up. Other embodiments will also suggest themselves to those skilled in the art.

The elastomeric ribbon R includes opposite major surfaces 8 having a width substantially greater than the thickness of the ribbon R, as previously discussed. To prevent transverse folding of the ribbon R during application of traversing force to the ribbon R by traversing means 20, the traversing force is applied to a major surface 8 of ribbon R generally in a direction parallel to the axial length of roll 25 while the surface 8 is positioned transversely, and preferably substantially perpendicularly, to the direction of the axial length of roll 25. The traversing force is applied alternately to opposite ones of the major surfaces 8 to traverse the ribbon R back and forth along the axial length (or portion thereof) of spool 30.

The guide means 21 or their equivalent are imperative in this invention because they apply the traversing force to the surface of the ribbon R so that folding of the ribbon does not occur. The guide means 21 should be positioned at a sufficient distance from the roll 25 such that the guide means 21 do not tend to bear against an edge of the ribbon R to cause its folding. On the other hand, qualified as above, the guide means 21 should be as close as possible to the roll 25 to prevent sag of ribbon R and enable relatively close control of the positioning on the roll 25 by the traversing means 20. Of course it would be expected that the distance between guide means 21 and the roll 25 will vary with the particular elastomeric material chosen, its width, rigidity and thickness and the tension utilized, among other factors, but this general parameter is a basic guide for materials of this type.

The traversing force applied to the ribbon R must be applied to the major surfaces 8 thereof and in the direction to traverse ribbon R along the axial length of the roll 25, i.e., parallel to the longitudinal axis thereof, but the surfaces 8 must be positioned substantially parallel to such axial length when the ribbon R engages the roll 25. Accordingly, the ribbon R is turned the necessary amount in the space between the guide means 21 and the roll 25 to change its orientation from transverse to parallel to the axial length of roll 25. Where the surfaces 8 are perpendicular to the axial length of the roll 25 during application of the traversing force by guide means 21, the turn will be 90°.

As the ribbon R engages the roll 25, it holds or grips the roll 25 due to the coefficient of friction u of the elastomeric material comprising ribbon R and the tension in ribbon R caused by the elongation of the ribbon R. As a result of the gripping of the roll 25 by the ribbon R, as the roll 25 rotates and transfers the ribbon R into engagement with the wound ribbon on the spool 30, the ribbon R will be placed on the spool 30 at a position determined by its position on the roll 25. In effect, the traverse or axial advance of the ribbon R as it is wound on the spool 30 will substantially linearly, i.e., proportionately, follow the traversing or axial advance of the ribbon R on the roll 25. Referring to FIG. 1, the transfer of the ribbon R from the roll 25 to the spool 30 preferably takes place in the area of engagement of the roll 25 with the wound ribbon on spool 30. Inasmuch as the respective axial lengths of the roll 25 and spool 30 are parallel, as best seen in FIG. 2, the area of engagement of the roll 25 and the wound ribbon on spool 30 extends along the axial length of the wound ribbon on spool 30. It is recognized in the art, and it should be noted here, that ribbon materials wound on a spool tend to form nodes on the wound spool. This tendency is particularly pronounced with elastomeric ribbon materials due to their elasticity and conformability, which tend to result in nodes on the wound spool which prevent effective winding of such materials. The tendency to node is more pronounced in elastomeric materials because they cannot be as easily guided or controlled due to their elasticity and because, due to their deformability, defects are easily transmitted through layers and accumulated. The reason that strip materials being wound on a spool tend to wind up at the top of a crown or node is that the lateral forces on the strip balance in opposite directions at the exact high point of the node to thereby maintain the node continuously at that point and cause the node to increase in diameter. The present invention, by its use of elastomeric material having the necessary coefficient of friction u and the proper elongating tension, overcomes the node problem and positively distributes the ribbon R on the spool 30.

The amount of elongation-creating tension in the ribbon R necessary to produce the required gripping effect on the roll 25 in combination with the coefficient of friction u of a polymeric elastomeric ribbon R is in the range of 2 to 8% elongation and preferably 4 to 5% elongation. The coefficient of friction values are in the range of 1.0 to 7.0 $u_2$ (static coefficient of friction) and 1.0 to 6.0 $u_k$ (kinetic coefficient of friction). Tuftane 410® polyurethane, which has been found to work very satisfactorily in the invention, has a $u_s$ of 2.0 and a $u_k$ also equal to 2.0. The coefficient of friction values stated herein are as determied using ASTM test D 1894-75.

Apparatus which, when properly modified, is useful for carrying out the process of the subject invention has been described in U.S. Pat. No. 2,940,322 and is sold by Amacoil Machinery, Inc., New Rochelle, N.Y. 10801. While machinery of this type has been used in the past to wind metal wire and the like, as far as is known, no one has previously modified the machinery as shown in this application, nor utilized the (modified) machinery for winding ribbon of the type described hereinabove.

When Tuftane 410® ribbon, which is available in rolls of 4,000 lineal feet, is wound according to the description associated with the FIGS. 1–2 of the illustrated embodiments of this invention, a suitable spool can be produced wherein the Tuftane® ribbon is wound to a depth of 10", a width of 12" and has 54,000 lineal feet of ribbon as opposed to the 4,000 lineal feet of ribbon associated with the single conventional slit roll.

It is also contemplated as being within the scope of the invention that the above process can be reversed so that the spool on which the ribbon is wound can serve as a feeding mechanism for commercial processes utilizing elastomeric ribbon material such as diaper manufacturing. According to these processes, elastomeric ribbon is fed from the wound spool through stationary guides with the wound spool again being driven by a surface roll onto a lineal receiving apparatus for direct addition to the ultimate commercial process as needed. Due to the presence of a substantial amount of lineal feet, the elimination of the twisting associated with previous attempts at feeding, and since no splicing is necessary on a regular basis, the utilization of this material in such commercial processes is simple and straightforward and furthermore lends itself to continuous processing necessarily associated with such processes.

Figure 3:
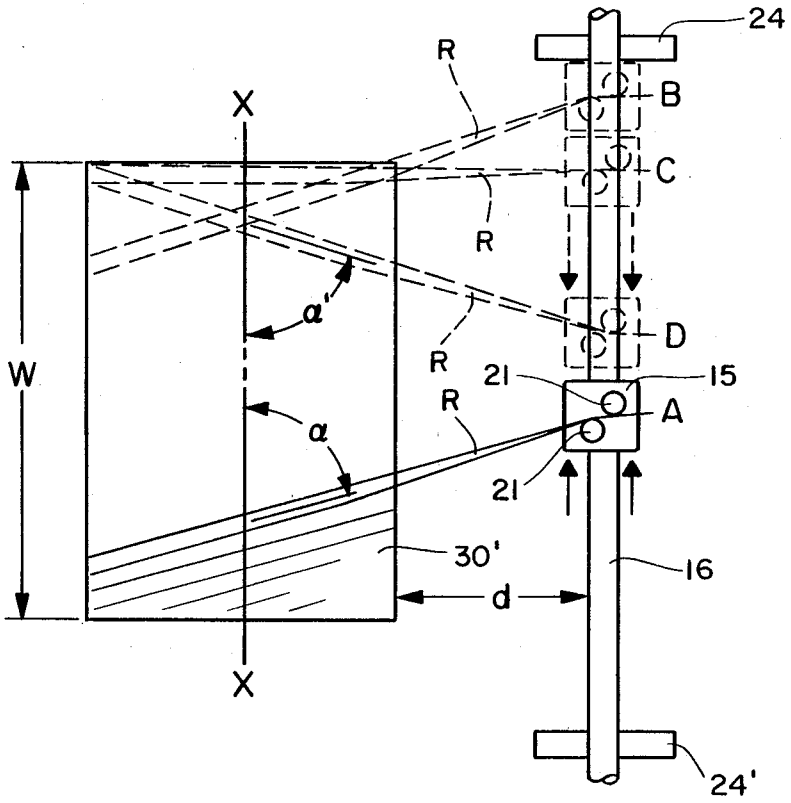
FIG. 3 is a schematic plan view illustrating the traversing sequence of guide means feeding the ribbon onto a spool including illustration of the winding angle between the ribbon and the spool.

One embodiment of the method of the invention provides for accelerating the reversing movement of the guide means in order to eliminate or minimize the formation of end nodes occasioned by excessive dwell time of the guide means at the ends of the spool upon which the ribbon is being wound. Referring now to FIG. 3, guide means 21 engage the ribbon R and traverse back and forth along shaft 16. Guide means 21 carried on carriage 15 at point A are illustrated as moving in the direction indicated by the unnumbered solid line arrows associated therewith. Most of the structure illustrated in FIGS. 1 and 2, such as surface drive roll 25, traversing means 20 and its associated rods 19, etc., are omitted from the simplified schematic illustration of FIG. 3 to simplify the illustration and explanation. However, it will be understood that such omitted structure or its equivalent is utilized in the manner described with respect to FIGS. 1–2 to obtain the same effect and may be modified as known to those skilled in the art to the extent necessary to provide accelerated turnaround as described hereinbelow. In order to apply ribbon R to spool 30' with each turn of the ribbon R being positioned in contiguous non-overlapping relationship to the adjacent turn of ribbon R, it is necessary that ribbon R be presented at a winding angle relative to the longitudinal axis X—X of spool 30', which angle will be reversed at the opposite ends of spool 30', between angles alpha and alpha' as shown in FIG. 3. The angles alpha and alpha' are measured between the longitudinal axis of ribbon R as it joins spool 30' and the longitudinal axis (X—X) of spool 30'. As carriage 15 and guide means 21 travel from position A to position B in the direction indicated by the unnumbered solid line arrows, a winding angle alpha is maintained. When carriage 15 and guide means 21 reach the end of their traverse and carriage 15 contacts a stop member 24 as illustrated at position B in FIG. 3, the guide means stop, reverse direction and traverse in the direction indicated by the unnumbered dotted line arrows associated with the dotted line showings of carriage 15 and guide means 21. Carriage 15 and guide means 21 thus travel the distance from position B to position C then D, at each of which they are shown in dotted line outline. At position D the winding angle alpha has been reversed to alpha' and, as carriage 15 and guide means 21 continue to travel in the direction indicated by the unnumbered dotted line arrows towards the opposite stop 24' the winding angle alpha' is maintained. When carriage 15 contacts stop 24' it stops and reverses direction for another traverse, in the initial part of which the winding angle is again reversed from alpha' back to alpha. It will be noted that the guide means 21 must traverse a linear distance between stops 24 and 24' which is greater than the width of spool 30 along its axis X—X. Consequently, if guide means 21 travels at constant average speed, the dwell time during which ribbon R is fed at the opposite ends of the spool 30' is extended because of the distance beyond the ends of spool 30' which the guide means 21 must traverse. The magnitude of the difference between the distance which the guide means 21 must traverse and the width W of spool 30' is determined by the distance d of the guide means 21 from the spool 30' and the winding angles alpha and alpha'. In the absence of accelerating movement of the guide means 21 during the angle reversal phase of its travel to increase its average speed during the winding angle reversal phase over that obtaining during the remainder of its traverse, and given a constant rotational speed of spool 30', excessive material would be wound on the opposite ends of the spool 30' during the turn-around or angle reversal phases. The result would be the build-up of end nodes on spool 30'.

As an alternative or supplement to the speeded-up winding angle reversal travel of guide means 21, the tendency to form end nodes may also be reduced by placing the guide means 21 closer to the spool 30', i.e., by reducing the distance d. However, with soft rubbery ribbon, if guide means 21 are placed too close to the spool 30', folding over of the ribbon is likely to occur because the ribbon must be twisted over an angle of as much as 90° between the time it leaves the guide means 21 and the time it is deposited upon the spool 30'. Use of very small winding angles alpha and alpha' and forming of tapered spools as described above in connection with FIGS. 1 and 2, by incrementally bringing the opposite stop members 24, 24' closer together as the spool is wound, also has a tendency to reduce and distribute the end nodes. Accordingly, in some cases it is possible to obtain reduction of end nodes sufficient to produce commercially acceptable wound spools without using the accelerated turn-around, by maintaining small winding angles alpha and alpha' and tapering the spool. On the other hand, accelerated turn-around as described above is effective in reducing end nodes and permits controlling the end nodes even with relatively high winding angles and/or non-tapered spools.

Generally, the winding angle is determined in the given case by the width of the ribbon R and the ratio of the rate of traverse of the guide means 21 relative to the linear winding rate of ribbon upon the spool.

It will be understood that the foregoing descriptions of the present invention are for purposes of illustration only and that the invention is susceptible to a number of modifications thereto which may be made without departing from the spirit and scope of the present invention as defined in the appended claims.

What is claimed is:

1. A method for winding onto a spool a soft elastomeric ribbon having wide surfaces of a width greater than its thickness, the spool having an axial length greater than the width of the ribbon, and the method comprising the steps of:

(a) feeding the ribbon from a ribbon source towards the spool;

(b) at a ribbon traversing station, maintaining the wide surfaces of the ribbon disposed transversely to the longitudinal axis of the spool and applying to only the wide surfaces of the ribbon a traversing force sufficient to traverse the ribbon along a traverse path parallel to the longitudinal axis of the spool;

(c) between the traversing station and the spool, turning the ribbon to dispose the wide surfaces thereof parallel to the longitudinal axis of the spool at a winding point where the ribbon is wound onto the spool; and (d) winding the ribbon on the spool.

2. The method of claim 1 wherein the traversing force applied to the ribbon is periodically reversed whereby to wind multiple layers of the ribbon onto the spool.

3. The method of claim 1 including supporting the ribbon adjacent to the point of transfer of the ribbon to the spool.

4. The method of claim 3 including supporting the ribbon by contacting a wide surface thereof on a support means under sufficient tension such that frictional engagement of the ribbon on the support means militates against node-forming tendencies of the ribbon on the spool.

5. The method of claim 1 including maintaining the ribbon under tension while feeding it from the ribbon source to the spool.

6. The method of claim 1 wherein the ratio of the width to the thickness of the ribbon is at least 3:1.

7. A method for winding onto a rotatable spool a soft elastomeric ribbon having wide surfaces of a width greater than its thickness, the spool having an axial length greater than the width of the ribbon, the method comprising the steps of:

(a) feeding the ribbon from a ribbon source to a traversing guide engaging only the wide surfaces of the ribbon and serving to maintain said wide surfaces disposed transversely to the longitudinal axis of the rotatable spool;

(b) passing the ribbon from the traversing guide to a support means disposed adjacent to the rotatable spool and then onto the spool, while turning the ribbon between the traversing guide and the spool so that said wide surfaces are parallel to the longitudinal axis of the spool at the point of being wound thereon;

(c) reciprocating a movement of the traversing means along a path parallel to the longitudinal axis of the spool to distribute the ribbon axially onto the spool; and (d) winding the ribbon on the spool.

8. The method of claim 7 including maintaining the ribbon under tension between the ribbon source and the rotatable spool.

9. The method of claim 7, wherein the support means comprises a driven roller and the winding step (d) further comprises the step of engaging the rotatable spool with the driven roller to rotate the spool.

10. The method of claim 7 including applying sufficient tension to the ribbon to elongate it from 2% to 8% of its untensioned length.

11. The method of claim 7 wherein the ribbon is a polyurethane ribbon.

12. The method of claim 7 wherein the ratio of the width to the thickness of the ribbon is at least 3:1.

13. The method of claim 2 including accelerating the ribbon traversing speed at the respective ends of the traverse path for a portion, less than one-half, of the traverse path whereby the average traversing speed at said ends is greater than the average traversing speed along the remainder of the traverse path.

14. The method of claim 2 or claim 7 including maintaining a winding angle of less than 90° between the longitudinal axis of the spool and that of the ribbon being wound thereon and reversing the winding angle at the respective ends of the traverse path and sufficiently accelerating the ribbon traversing speed during reversal of the winding angle whereby the average ribbon traversing speed during reversal of the winding angle is greater than the average ribbon traversing speed along the remainder of its traversing path.

15. The method of claim 2 or claim 7 including gradually reducing the length of the traverse path by incrementally moving the respective ends thereof inwardly towards each other whereby to provide a tapered wound spool of ribbon.

* * * * *